US011493856B2

(12) United States Patent
Hiramatsu et al.

(10) Patent No.: US 11,493,856 B2
(45) Date of Patent: Nov. 8, 2022

(54) DEVELOPING DEVICE, REGULATING MEMBER, PROCESS CARTRIDGE, AND IMAGE FORMING APPARATUS

(71) Applicant: CANON KABUSHIKI KAISHA, Tokyo (JP)

(72) Inventors: Takashi Hiramatsu, Tokyo (JP); Takahiro Kawamoto, Kanagawa (JP); Shoko Funaki, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/482,543

(22) Filed: Sep. 23, 2021

(65) Prior Publication Data

US 2022/0113654 A1 Apr. 14, 2022

(30) Foreign Application Priority Data

Oct. 14, 2020 (JP) ..... JP2020-173316

(51) Int. Cl.

*G03G 15/08* (2006.01)
*G03G 9/08* (2006.01)
*G03G 21/18* (2006.01)

(52) U.S. Cl.

CPC ..... *G03G 15/0812* (2013.01); *G03G 9/0819* (2013.01); *G03G 15/0808* (2013.01); *G03G 21/1814* (2013.01)

(58) Field of Classification Search

None

See application file for complete search history.

(56) References Cited

U.S. PATENT DOCUMENTS 4,470,689 A * 9/1984 Nomura ..... G03G 21/1832 355/71
8,909,110 B2 12/2014 Nishida
9,442,418 B2 9/2016 Kawamoto et al.
(Continued)

FOREIGN PATENT DOCUMENTS

EP 1 507 175 A2 2/2005
JP H11-249422 A 9/1999
(Continued)

OTHER PUBLICATIONS

European Search Report dated Feb. 23, 2022, in related European Patent Application No. 21199350.6.

*Primary Examiner* — Sevan A Aydin
(74) *Attorney, Agent, or Firm* — Venable LLP

(57) ABSTRACT

A developing device includes a regulating member fixed to a frame at one end thereof and including a contact portion which contacts a developer carrying member. The contact portion includes a first region positioned upstream of a reference position and a second region positioned downstream of the reference position in a rotational direction of the developer carrying member. A length of the second region is longer than a length of the first region in a position corresponding to a contact nip with respect to a direction from a fixed end of the regulating member toward the other end as a free end of the regulating member, and the contact portion has a surface roughness smaller in the first region than in the second region, with the surface roughness in the second region being 20% or less of an average particle size of toner particles contained in a developer.

13 Claims, 4 Drawing Sheets

(56) References Cited

U.S. PATENT DOCUMENTS

| | | | | |
|---|---|---|---|---|
| 2007/0114357 | A1 | 5/2007 | Goto | |
| 2013/0322932 | A1 | 12/2013 | Nishida | |
| 2016/0252869 | A1 | 9/2016 | Hagimoto et al. | |
| 2018/0120737 | A1* | 5/2018 | Okamoto ..... | G03G 15/0889 |

FOREIGN PATENT DOCUMENTS

| | | | |
|---|---|---|---|
| JP | 2001-117356 | A | 4/2001 |
| JP | 2001-117357 | A | 4/2001 |
| JP | 2005-274756 | A | 10/2005 |
| JP | 2013-167668 | A | 8/2013 |
| JP | 2013-250333 | A | 12/2013 |
| JP | 2017-116920 | A | 6/2017 |

* cited by examiner

DEVELOPING DEVICE, REGULATING MEMBER, PROCESS CARTRIDGE, AND IMAGE FORMING APPARATUS

FIELD OF THE INVENTION AND RELATED ART

The present invention relates to an image forming apparatus, and a developing device, a regulating member, and a process cartridge which are used in the image forming apparatus. Particularly, the present invention relates to an electrophotographic image forming apparatus employing an electrophotographic type, and a developing device, a regulating member, and a process cartridge which are used in the electrophotographic image forming apparatus.

Conventionally, in the developing device used in the image forming apparatus, a developing blade is used as a means for controlling an amount of a developer carried on a surface of a developing roller.

In general, one end of the developing blade is contacted to the surface of the developing roller and appropriate contact pressure is formed during rotation of the developing roller, so that a coated layer substantially uniform in developer amount (layer thickness) can be formed on the developing roller. Further, the developer contained in the coated layer is rubbed when the developer passes through a contact nip between the developing roller and the developing blade, so that electric charge (triboelectric charge) is imparted to the developer through triboelectric charging.

Further, from the view point of reduction in energy consumption, "low melting point" of the developer used for image formation has been required. In order that even the developer (toner particles) with a low melting point is not readily crushed by "contact pressure" between the developing roller and the developing blade, in Japanese Laid-Open Patent Application (JP-A) Hei 11-249422, a constitution in which a shape of the developing blade is defined has been proposed. According to the constitution of JP-A Hei 11-249422, a lowering in "contact pressure" is realized, so that fusion of toner particles to a component part due to the crush of the toner particles is alleviated.

However, for the purpose of further improvement in image quality, improvement of "reduction in particle size" of the developer has been required. With a smaller particle size, in the constitution of JP-A Hei 11-249422 as in a conventional constitution, there is a possibility that uniformity of the amount of the developer (coated layer) on the developing roller is liable to lower with respect to a slight change in shape and contact pressure of the developing blade. Moreover, there is also a possibility that a charge amount of the developer by the triboelectric charging is liable to become insufficient. In this case, as a printed image, a stripe-shaped image defect with respect to a vertical direction (recording paper feeding direction) and an image defect such that image density causes non-uniformity (unevenness) is liable to occur.

SUMMARY OF THE INVENTION

In view of the above-described problems, a principal object of the present invention is to provide a constitution capable of easily enhancing uniformity of an amount of a developer (developer-coated layer) while suppressing a lowering in charging property of developer particles contained in a developer-coated layer.

According to an aspect of the present invention, there is provided a developing device comprising: a frame; a cylindrical developer carrying member rotatably supported by the frame and configured to carry a developer containing toner particles; and a regulating member fixed to the frame at one end thereof and including a contact portion which contacts the developer carrying member at the other end of the regulating member and which forms a contact nip between itself and the developer carrying member, wherein when a position of the contact portion where a maximum of a pressure distribution of the contact portion to the developer carrying member with respect to a rotational direction of the developer carrying member is indicated is a reference position, the contact portion includes a first region positioned upstream of the reference position and a second region positional downstream of the reference position with respect to the rotational direction, and wherein the contact portion has surface roughness smaller in the first region than in the second region, the surface roughness in the second region being 20% or less of an average particle size of the toner particles contained in the developer.

Further features of the present invention will become apparent from the following description of exemplary embodiments with reference to the attached drawings.

DESCRIPTION OF THE EMBODIMENTS

In the following, an electrophotographic image forming apparatus according to the present invention will be described with reference to the drawings.

Incidentally, embodiments described in the following merely illustratively describe the present invention, and as regards dimensions, materials, shapes, relative positional relationship, and the like of constituent elements described below, a scope of the present invention is not limited thereto unless otherwise specified.

Here, the electrophotographic image forming apparatus refers to one for forming an image on a recording medium (material) by using an electrophotographic type. Further, examples of the electrophotographic image forming apparatus include an electrophotographic copying machine, an electrophotographic printer (for example, a laser beam printer, an LED printer, or the like), a facsimile machine, a word processor, and the like.

Further, a developing device used in the image forming apparatus includes at least a developing means. A regulating member is a member which is one of members constituting the developing means included in the developing device. The developing device can be assembled into a cartridge (unit), which is mountable and dismountable from a main assembly of the electrophotographic image forming apparatus.

Further, a process cartridge constituting a part of the image forming apparatus is prepared by integrally assembling a charging means, the developing means, or a cleaning means and an electrophotographic photosensitive drum into a cartridge, and this cartridge is made mountable in and dismountable from the main assembly of the electrophotographic image forming apparatus. Further, this cartridge is one prepared by integrally assembling at least one of the charging means, the developing means, and the cleaning means with the electrophotographic photosensitive drum into the cartridge, which is capable of being mounted in and dismounted from the main assembly of the electrophotographic image forming apparatus. Further, there is also a process cartridge prepared by integrally assembling the developing means and the electrophotographic photosensitive drum into a cartridge, which is made detachably mountable to the main assembly of the electrophotographic image forming apparatus. Incidentally, the process cartridge can also be used in a state of being fixed to the image forming apparatus.

Embodiment

In the following, an embodiment of the present invention will be specifically described on the basis of FIGS. 1 to 4.

<General Structure of Image Forming Apparatus>

Figure 2:
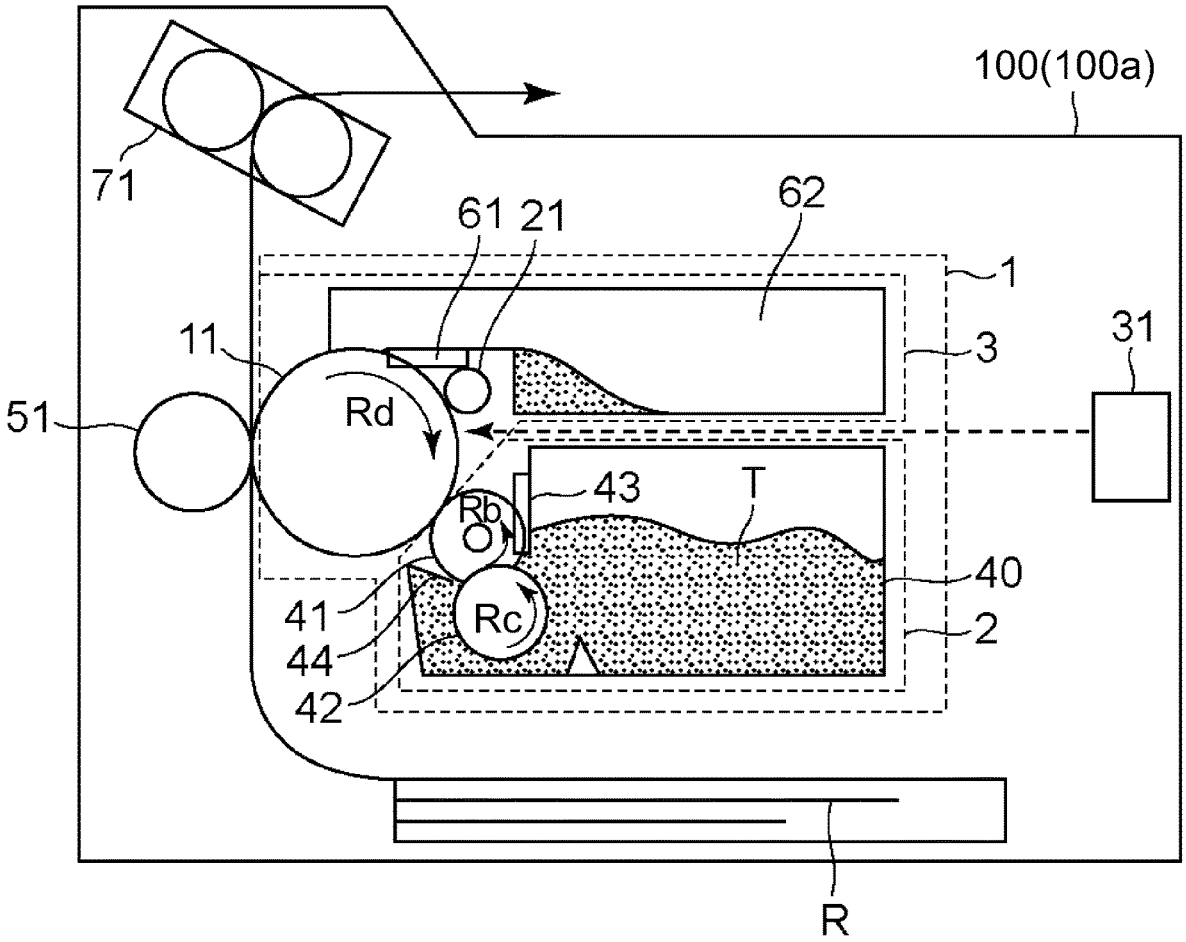
FIG. 2 is a schematic sectional view of the image forming apparatus according to the embodiment of the present invention.

First, with reference to FIG. 2, a general structure of the image forming apparatus according to this embodiment will be described. FIG. 2 is a schematic sectional view of the image forming apparatus according to this embodiment.

As shown in FIG. 2, an image forming apparatus 100 according to this embodiment includes a process cartridge 1 constituted so as to be mountable in and dismountable from the image forming apparatus. That is, the process cartridge 1 can be inserted into and removed from an apparatus main assembly 100*a*.

The process cartridge 1 is formed by a developing unit (developing device) 2 which is a developing means and a photosensitive drum unit 3. The photosensitive drum unit 3 is consisting of a photosensitive member 11 as an image bearing member, a charging roller 21 as a charging means for electrically charging the photosensitive member 11, and a cleaning blade 61 as a cleaning means for the photosensitive member 11.

Incidentally, at a periphery of the photosensitive member 11, the charging roller 21 and a developing roller 41 which is mounted in the developing unit 2 and which carries toner as a developer (T) in order to develop, with the developer, an electrostatic latent image formed on a surface of the photosensitive member 11 are provided. Further, at the periphery of the photosensitive member 11, a transfer roller 51 for transferring the toner from the photosensitive member 11 onto a recording material R and the cleaning blade 61 for removing transfer residual toner remaining on the photosensitive member 11 without being transferred onto the recording material R are provided.

Further, in the developing unit (developing device) 2, at a periphery of the developing roller 41, a toner supplying roller 42 for supporting the toner to the developing roller 41 and for scraping off the toner from the developing roller 41 is provided. Further, in the developing unit 2, a developing blade 43 as a (toner amount) regulating member for regulating an amount of the toner, supplied to the developing roller 41, to a desired toner amount (thickness of the coated layer) is provided.

Further, a toner image formed by the toner and transferred on the recording material R is fixed to the recording material R under application of predetermined pressure and predetermined heat when the recording material R passes through a fixing device 71.

Incidentally, a transfer roller 51 and a laser exposure unit 31 for forming, on the charged photosensitive member 11, the electrostatic latent image corresponding to image data are also mounted in the apparatus main assembly 100*a* of the image forming apparatus 100.

Further, in the image forming apparatus 100, voltage sources (not shown) for applying predetermined voltages to the charging roller 21, the developing roller 41, the developing blade 43, the toner supplying roller 42, and the transfer roller 51 are mounted.

<Image Forming Operation>

Next, with reference to FIG. 2, an image forming operation in the image forming apparatus of this embodiment will be specifically described.

In this embodiment, when the image forming operation is started, the photosensitive member 11 is rotationally driven in a direction Rd by a photosensitive member during motor (not shown). Incidentally, a surface speed of the rotationally driven photosensitive member 11 is 180 mm/sec.

The photosensitive member 11 is a so-called organic photosensitive member in which a charge generating layer is formed on an electroconductive core metal of aluminum or the like and a charge transporting layer is formed on the charge generating layer. In this embodiment, a layer thickness of the charge transporting layer is 23 μm.

The charging roller 21 contacted to the photosensitive member 11 is a roller coated with a predetermined resistance layer at a surface of a cylindrical electroconductive supporting member, and cylindrical opposite end portions of the electroconductive supporting member are pressed with springs, so that the charging roller 21 is rotated with rotation of the photosensitive member 11. Incidentally, to the charging roller 21, a negative voltage of −1100 V is applied at a predetermined timing from a charging voltage source (not shown) in order to charge the photosensitive member surface, so that the surface of the photosensitive member 11 is negatively charged uniformly and thus becomes −500 V as a "dark-portion potential".

Incidentally, the laser exposure unit 31 for exposing the charged photosensitive member 11 with light exposes the surface of the photosensitive member 11 with a laser beam with respect to a main scan direction (photosensitive member rotational axis direction). Further, also with respect to a sub-scan direction (photosensitive member surface rotation movement direction), the exposure is carried out by matching a timing, an "electrostatic latent image" is formed. An image forming portion (electrostatic latent image forming portion) subjected to exposure becomes −100 as a "light portion potential".

In this embodiment, the developing roller 41 mounted in the developing unit (developing device) 2 contacts the photosensitive member 11 during image formation and performs a developing operation in which the formed electrostatic latent image is developed. Incidentally, to the developing roller 41, −350 V is applied as a developing voltage from a voltage source (not shown) for the developing roller 41, and the toner is transferred from the developing roller 41 onto the photosensitive member 11 by a potential difference between the developing roller 41 and the photosensitive member 11, so that the electrostatic latent image is visualized by the toner.

In this embodiment, the developing roller 41 is rotated in a direction opposite to the rotational direction of the photosensitive member 11, and a surface speed thereof is 1.4 times the surface speed of the photosensitive member 11.

A toner image formed on the photosensitive member 11 by visualizing (developing) the electrostatic latent image by the developing roller 41 is sent to a contact portion of the transfer roller 51, and is transferred onto the recording material R fed by being timed to the toner image. Incidentally, in this embodiment, to between the transfer roller 51 and the photosensitive member 11, 1000 V is applied as a transfer bias to the transfer roller 51 by a transfer voltage source (not shown).

Then, the recording material R on which the toner image is transferred is sent to the fixing device 71. In the fixing device 71, heat and pressure are applied to the recording material R, so that the transferred toner image is fixed on the recording material R.

On the other hand, the transfer residual toner which was not transferred at the transfer portion is removed by the cleaning blade 61. The cleaning blade 61 is mounted so that a free end thereof extends toward an upstream side of the rotational direction Rd of the photosensitive member 11 (in a "counter direction"). Further, the free end of the cleaning blade 61 mounted in the counter direction is contacted to the photosensitive member 11 with appropriate pressure, so that the transfer residual toner can be removed from the photosensitive member 11. Further, the surface of the photosensitive member 11 is charged by the charging roller 21 in a state in which there is no toner or the like (in which the toner or the like is removed).

By repeating such a step, the toner image is formed on the recording material R. On the other hand, the toner removed from the photosensitive member 11 by the cleaning blade 61 is accommodated in a residual toner accommodating chamber 62. In this embodiment, in order to minimize the transfer residual toner, spherical silica of about 100 nm in diameter is externally added to the toner, so that improvement in transfer property of the toner (image) is realized. By this, contact between a base material of the toner (base toner particles) and the photosensitive member 11 is appropriately prevented, so that a toner depositing force on the surface of the photosensitive member 11 is positively controlled and thus the transfer property is improved.

<Developing Unit>

Next, the developing unit (developing device) 2 of this embodiment will be described in detail.

As shown in FIG. 2, the developing unit (developing device) 2 of this embodiment includes a developing container (frame) 40 and is supported by the developing container (frame) 40 so that the developing roller (developer carrying member) 41 and the toner supplying roller 42 are rotatable. Incidentally, the developing roller 41 is formed in a cylindrical shape so that the toner is capable of being carried on an outer peripheral surface thereof.

The toner supplying roller 42 is disposed so as to contact the outer peripheral surface of the developing roller 41. By the toner supplying roller 42, the toner is supplied to the developing roller 41, so that the toner is carried on the surface of the developing roller 41.

Rotational directions of the developing roller 41 and the toner supplying roller 42 are the same direction as indicated by arrows Rb and Rc, respectively, in FIG. 2 (are opposite directions at peripheral surfaces of these rollers at a contact portion of these rollers). The developing roller 41 is a roller prepared by providing an electroconductive elastic rubber layer with a predetermined volume resistance on a peripheral surface of a core metal, and a surface thereof has predetermined surface roughness.

The toner supplying roller 42 is a roller prepared by providing a urethane foam layer on a peripheral surface of a core metal, and a volume resistance thereof is adjusted to a predetermined value. On a surface layer of this urethane foam layer, foam cells open, so that the toner is easily held and fed.

The developing blade (regulating member) 43 is constituted by a flexible elastic plate (for example, SUS plate), and one end 431 thereof is fixed to the developing container (frame) 40 and the other end 432 thereof is a free end. The developing blade 43 is disposed so as to form a contact nip N between itself and the surface of the developing roller 41.

The toner supplied to the developing roller 41 by the toner supplying roller 42 is regulated by the free end 432 of the developing blade 43, so that a substantially uniform toner coated layer (not shown) is formed.

Further, the toner coated layer is disposed so that the toner is rubbed by plate (blade) surfaces (Z10, Z20) close to the free end (the other end) 432 of the developing blade 43 and by the surface of the electroconductive elastic rubber layer of the developing roller 41. For this reason, the toner is triboelectrically charged simultaneously with formation of the toner coated layer, so that triboelectric charge is imparted to the toner. Incidentally, in this embodiment, the developing blade 43 is constituted by using a SUS material.

In order to prevent leakage of the toner in the developing unit 2 to an outside of the developing unit 2, a sheet 44 for preventing the leakage is sticked on the developing container (frame 40), so that the sheet 44 and the developing roller 41 are in contact with each other in an appropriate state and thus the toner in the developing container 40 is prevented from leaking out to the outside of the developing container 40. The sheet 44 is a flexible sheet, and in this embodiment, a sheet of PPS resin in material and 60 μm in thickness is employed. The sheet 44 is mounted to the developing container 40 at a contact pressure of a degree such that the toner is not leaked out of the developing container 40.

In this embodiment, the toner is 7.0 μm in center toner particle size, and as an external additive, silica is used. By externally adding the silica, flowability of the toner is ensured, so that lifetime extension of the cartridge and maintenance of an image quality are easily achieved. Incidentally, as regards the flowability of the toner, in this embodiment, measurement thereof was made by using a power tester PT-X manufactured by Hosokawa Micron Corp. The flexibility of the toner employed in this embodiment was 50.

<Relationship Between Coated Layer and Regulating Member>

Figure 1:
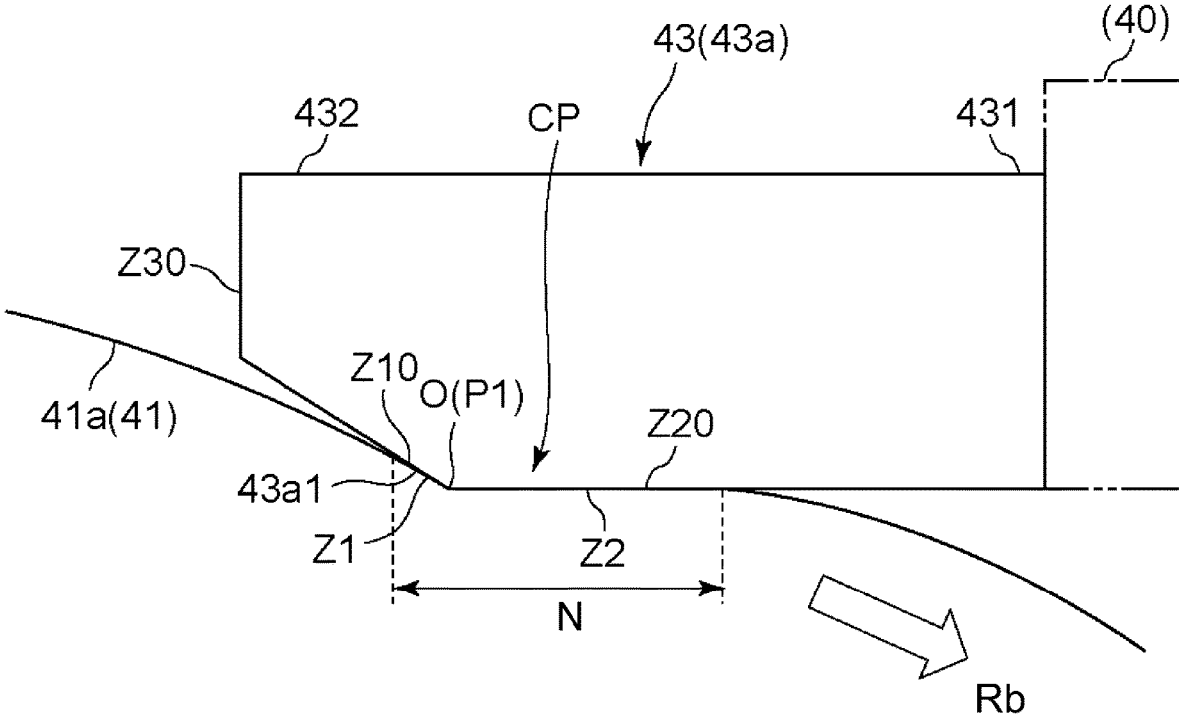
FIG. 1 is a schematic sectional view showing a state of contact between a developing blade and a developing roller which are used in an image forming apparatus according to an embodiment of the present invention.
Figure 3:
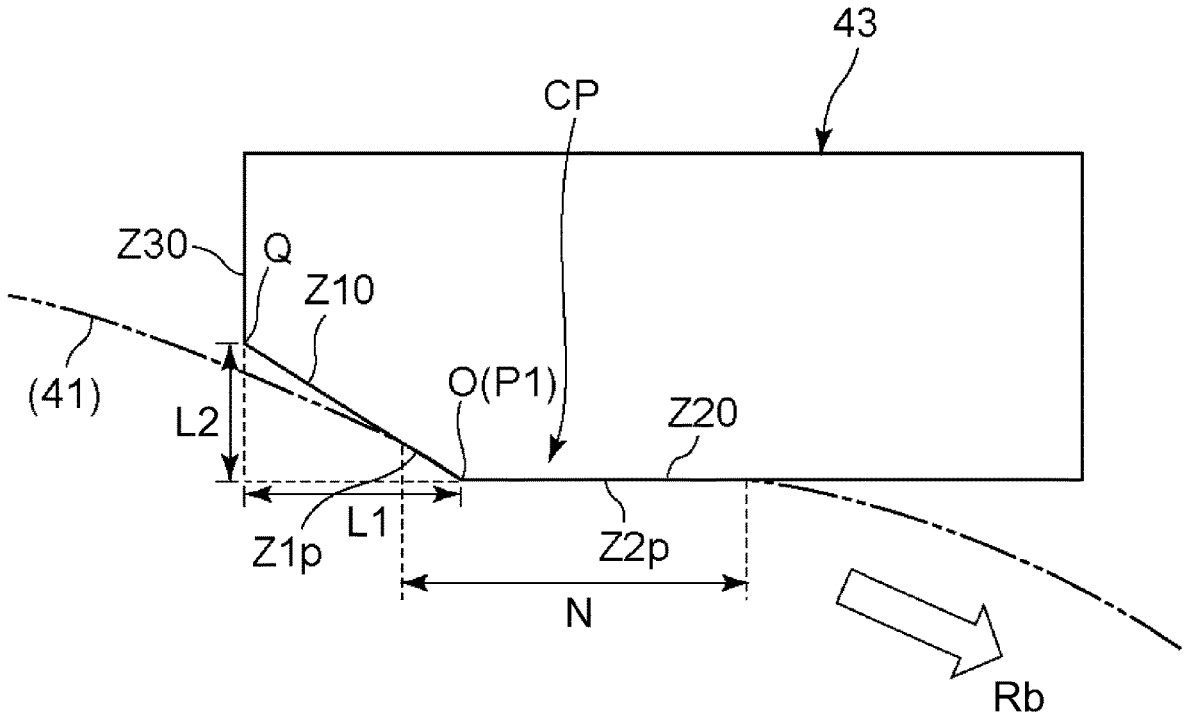
FIG. 3 is a schematic sectional view of the developing blade used in the image forming apparatus according to the embodiment of the present invention.
Figure 4:
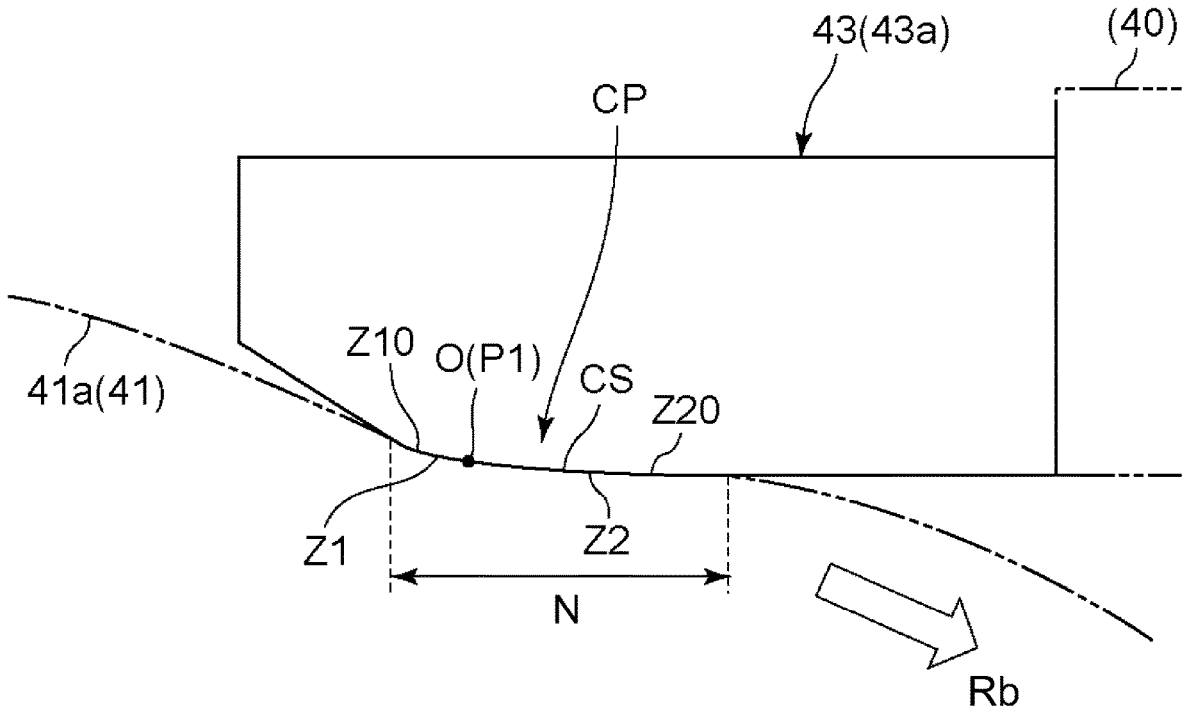
FIG. 4 is a schematic sectional view of a developing blade in a modified embodiment of the present invention.

Next, the developing blade (regulating member) 43 of this embodiment, and a relationship between the toner coated layer and the regulating member will be specifically described using FIGS. 1, 3 and 4.

FIG. 1 is a schematic sectional view (perpendicular to a rotational axis of the developing roller 41) showing a state in which the developing blade 43 and the developing roller 41 which are used in the image forming apparatus of this embodiment are in contact with each other. FIG. 3 is a schematic sectional view of the developing blade 43 of this embodiment. FIG. 4 is a schematic sectional view showing a modified example (embodiment) of the developing blade 43 of this embodiment.

As shown in FIGS. 1 and 3, in this embodiment, the developing blade 43 is provided at the other end 432 thereof with a contact portion CP contacting the developing roller 41 and forming the contact nip N between itself and the developing roller 41. Incidentally, the other end 432 of the developing blade 43 is mounted to the developing container (developing device) 40 so as to extend toward an upstream side of the developing roller 41 with respect to the rotational direction Rb.

In this embodiment, at the contact portion CP, a position O where a maximum (contact peak pressure portion P1) of a pressure distribution to the developing roller 41 with respect to the rotational direction Rb of the developing roller 41 is a reference position. At this time, in the contact portion CP, surface roughness of the developing blade 43 in a first region Z1 positioned on a side upstream of the reference position is smaller than surface roughness of the developing blade 43 in a second region Z1 positioned on a side downstream of the reference position.

Incidentally, in this embodiment, the contact portion CP includes a first surface portion Z10 forming the contact nip N and a second surface portion Z20 which is positioned on a side downstream of the first surface portion Z10 with respect to the rotational direction Rb, which is connected to the first surface portion Z10, and which forms the contact nip N. The first surface portion Z10 and the second surface portion Z20 are flat surfaces Z1*p* and Z2*p*, respectively. The first region Z1 is formed at the first surface portion Z10 (Z1*p*), and the second region Z20 is formed at the second surface portion Z20 (Z2*p*).

Specifically, the surface of the developing roller 41 moves (rotates) along the rotational direction Rb. Control of a thickness (regulation of an amount) of the toner coated layer carried on the surface of the developing roller 41 is carried out at the position O (contact peak pressure portion) where the pressure (distribution) becomes a maximum principally in the contact nip N in which the developing blade 43 and the developing roller 41 are in contact with each other.

Peak pressure is formed at a portion where an angle and curvature of the developing blade 43 become smallest in the contact nip N. For example, in FIG. 1, the contact portion CP of the developing blade 43 is set so that the peak pressure is formed at a point of an angular position O where the two flat surfaces Z10 and Z20 cross each other.

When an angle of the developing blade 43 is unchanged in the contact nip N (for example, when a contact surface of the developing blade 43 in the contact nip N is a flat surface or when curvature of the contact surface is substantially unchanged), the peak pressure is formed at the center of the contact nip N. That is, in FIG. 1, the position of the peak pressure when the angle of the developing blade 43 is unchanged in the contact nip N (when the contact surface of the developing blade 43 in the contact nip N is the flat surface) is shown.

On the other hand, in the modified example (embodiment) shown in FIG. 4, in the case of a cleaning blade 43 such that curvature of the cleaning blade 43 changes in the contact nip N, peak pressure is formed at a portion (position O) where the curvature becomes smallest. That is, in a constitution shown in FIG. 4, a contact peak pressure portion P1 (reference position) is formed at the position O (O position) where the curvature becomes smallest.

In this embodiment, the contact pressure of the developing blade 43 is set at about 20 gf/cm.

Next, control of the surface roughness of the developing blade 43 in the contact nip N in this embodiment will be described.

As shown in FIG. 1, in this embodiment, the surface roughness of the cleaning blade 43 at the contact portion CP is set at different values, between the upstream-side first region Z1 and the downstream-side second region Z1, with the contact peak pressure portion generating position (O position) as a boundary.

Specifically, as shown in FIG. 1, in this embodiment, the contact portion CP is constituted by the plurality (two) of the flat surface portions, and the position (O position) of the contact peak pressure portion is a position where an angle formed by the crossing (two) flat surfaces becomes smallest. Incidentally, as shown in the modified example of FIG. 4, in the case where the contact portion Cp is constituted by a curved surface portion, not the flat surface portions, the position of the contact peak pressure portion is the position (O position) where the curvature becomes smallest.

Specifically, in this embodiment, as shown in FIG. 1, the roughness is changed between the first surface portion Z10 and the second surface portion Z20, and the roughness is made smaller in the first surface portion Z10 than in the second surface portion Z20. Here, the first surface portion Z10 and the second surface portion Z20 are the two flat surfaces constituting the contact portion CP of the developing blade 43. The first region Z1 and the second region Z2 are portions positioned in the contact nip N, and the first region Z1 is a part of the first surface portion Z10 and the second region Z2 is a part of the second surface portion Z20.

The reason why the roughness of the first surface portion Z10 is made small is that image defect which is a "vertical stripe" due to the developing blade 43 is suppressed.

That is, in order to control a toner regulating amount (thickness of the coated layer), the first surface portion Z10 constitutes a contact surface until (immediately before) the toner enters the contact peak pressure portion and the toner moves in the rotational axis direction (longitudinal direction) of the developing roller 41 along the first surface portion Z10 until the toner reaches the peak pressure portion CP. Depending on a surface state (particularly roughness) of the first surface portion Z10, an amount of the toner which reaches the peak pressure portion CP cannot become uniform over an entire region with respect to the rotational axis direction (longitudinal direction) of the developing roller 41 in some instances.

In this case, the amount of the toner immediately before the contact peak pressure portion P1 (regulation) is different with respect to the longitudinal direction, and the amount of the toner (thickness of the coated layer) after passing (regulation) of the toner through the contact peak pressure portion P1 is also different with respect to the longitudinal direction. Due to this, the "vertical stripe"-like image defect generates. From the above-described reason, in this embodiment, the roughness of the first surface portion Z10 is made relatively small in order that the toner amount becomes further uniform until the toner reaches the contact peak pressure portion P1.

On the other hand, the reason why the second surface portion Z20 is roughened more than the first surface portion Z10 is that the triboelectric charge is imparted to the toner through triboelectric charging.

Impartment of the triboelectric charge to the toner is realized through the triboelectric charging by contact with the developing blade 43 after regulation of the toner amount (coated layer thickness) at the peak pressure portion CP. Accordingly, in order to positively provide an opportunity to contact the second surface portion Z20, the roughness of the second surface portion Z20 is set so as to be relatively large.

In the case where the roughness is small, there is a possibility that impartment of the triboelectric charge at the second surface portion Z20 is not sufficiently performed. Particularly, in the case where the image forming apparatus 100 is used in an environment (for example, a temperature of 32° C. and a humidity of 80% RH) in which the triboelectric charge is not readily imparted and both the temperature and the humidity are high, when the impartment of the triboelectric charge is not sufficient, in some instances, a "toner stagnation" phenomenon occurs on the developing blade 43 and the sheet 44 for leakage prevention.

One of factors causing the "toner stagnation" (phenomenon) would be considered that the triboelectric charge of the toner lowers. That is, when the triboelectric charge of the toner is low, an electrostatic depositing force onto the developing roller 41 becomes small, and thus the toner is liable to be deposited on another member contacting the developing roller 41, so that the toner stagnation phenomenon occurs.

In this case, due to an insufficient depositing force, the toner coated layer after regulation drops from the surface of the developing roller 41 (hereinafter, this is also referred to as a "coated layer drop"), so that there is a possibility that image defect is caused. Further, in the case where due to the deposition of the toner on another member, the toner stagnation occurs many times, when the cartridge is removed from the apparatus main assembly and is exchanged, there is a possibility that contamination with the toner due to scattering of the deposited toner occurs. For that reason, in this embodiment, there is a need that the triboelectric charge of the toner is made a proper value by relatively increasing the roughness of the developing blade 43 at the second surface portion Z20.

Thus, in this embodiment, the surface roughness of the developing blade 43 at the contact portion CP with the contact peak pressure portion P1 (portion where the angle and the curvature become minimum) in the contact nip N as a boundary. That is, the roughness on an upstream side of the rotational direction Rb of the developing roller 41 is made small (the roughness at the first surface portion Z10 is made small), and the roughness on a downstream side is made larger than the roughness on the upstream side (the roughness at the second surface portion Z20 is made larger than the roughness at the first surface portion Z10). By this, an appropriate triboelectric charge is imparted to the toner while suppressing occurrence of the above-described "vertical stripe" phenomenon, whereby it is possible to suppress the coated layer drop, the contamination due to the toner stagnation, and the like.

In other words, in the contact nip N, the surface roughness is made relatively small in the first region Z1 on a side upstream of the position (O position) where the contact peak pressure portion P1 is set. By this, the developer more easily moves in an axial direction (longitudinal direction) of the developer carrying member, so that uniformization of a developer coated layer (thickness) with respect to the longitudinal direction is promoted.

Simultaneously, in the second region Z2 on a side downstream of the position O where the contact peak pressure portion P1 is set, the surface roughness is made relatively large, so that a triboelectric charging action on the developer is easily promoted. As a result of this, by controlling the surface roughness of the developing blade 43 in the contact portion CP in the contact nip N, improvement in uniformity of the developer amount (developer coated layer) with respect to the longitudinal direction and improvement in charging property of developer particles contained in the developer coated layer are easily realized compatibly.

<Evaluation>

Next, by using the developing blade 43 of this embodiment, performances thereof will be evaluated by the following experiment.

In FIG. 1 or 3, a cross-sectional shape of the developing blade 43 in this embodiment is shown. A shape of a free end of the developing blade 43 of this embodiment is formed by polishing (processing). That is, before the processing, an original developing blade has a plate shape, and the second surface portion Z20 and a third surface portion Z30 are perpendicular to each other. A point of intersection (etch portion) of the second surface portion Z20 and the third surface portion Z30 is subjected to polishing at a desired angle, so that the first surface portion Z10 and the point O (corner portion) are formed.

Specifically, in this embodiment, as shown in FIG. 3, a distance L1 from the point O to a flat surface where the third surface portion Z30 exist is set at 50 μm. A distance L2 from a point Q which is a point of interaction (corner portion) of the third surface portion Z30 and the first surface portion Z10 to a flat surface where the second surface portion Z20 exists is set at 15 μm. A corner (etch portion) of a SUS plate material constituting the developing blade is subjected to polishing so that the distances L1 and L2 have the above-described values.

Further, by changing polishing roughness for forming the first surface portion Z10, the shape and the roughness of the contact portion CP are changed, and then the following experiment was conducted.

First, an occurrence status of the vertical stripe phenomenon was checked by changing roughness Rz of the developing blade at the first surface portion Z10. Specifically, four developing blades for experiment examples 1 to 4, respectively, were prepared and were subjected to measurement to the roughness Rz at the first surface portion Z10. Measured values of the roughness Rz were 0.12 μm in the experiment example 1, 0.21 μm in the experiment example 2, 0.23 μm in the experiment example 3, and 0.75 μm in the experiment example 4. As regards the roughness Rz at the second surface portion Z20, all the measured values of the roughness Rz were 0.71 μm.

For measurement of the roughness Rz, a laser microscope VK-200 manufactured by KEYENCE Corp. was used, and the measurement was made using an objective lens with 20-fold magnification. By using Rz as the roughness of the developing blade, it is possible to represent a resistance when the toner and the developing blade move relative to each other.

By using the developing blades in the above-described experiment examples, the occurrence status of the "vertical stripe" and an occurrence status of the "toner stagnation" through a sheet-passing experiment in a high-temperature/high-humidity environment were verified, and were evaluated, respectively.

Evaluation results for the respective experiment example are shown in a table 1.

TABLE 1

| EE*1 | 1 | 2 | 3 | 4 |
|---|---|---|---|---|
| FSPRz*3 | 0.12 μm | 0.21 μm | 0.23 μm | 0.75 μm |
| SSPRz*3 | 0.71 μm | 0.71 μm | 0.71 μm | 0.71 μm |
| VSP*4 | A | B | B | C |
| TS*5 | A | A | A | A |

*1"EE" is the experiment example.
*2"FSPRz" is the roughness Rz at the first surface portion.
*3"SSPRz" is the roughness Rz at the second surface portion.
*4"VSP" is the vertical stripe phenomenon.
*5"TS" is the toner stagnation.
A: Unrecognizable
B: Very slight
C: Slight
D: Recognizable on normal image
(E: Conspicuous image defect)

As can be understood from the table 1, with respect to the rotational direction Rb of the developing roller, the roughness Rz on a side upstream of the contact peak pressure portion P1 has the influence on the occurrence of the vertical stripe phenomenon. In this embodiment, the roughness Rz at the upstream-side first surface portion is made 0.21 μm or less, so that the occurrence of the stripe can be more effectively suppressed.

Next, an experiment similar to the above-described experiment by changing the roughness at the second surface portion Z20. Incidentally, all of values of the roughness at the first surface portion in the experiment example 1 and experiment examples 5, 6 and 7 are 0.12 μm.

Evaluation results for the respective experiment example are shown in a table 2.

TABLE 2

| EE*1 | 1 | 5 | 6 | 7 |
|---|---|---|---|---|
| FSPRz*3 | 0.12 μm | 0.12 μm | 0.12 μm | 0.12 μm |
| SSPRz*3 | 0.71 μm | 0.25 μm | 0.10 μm | 1.57 μm |
| VSP*4 | A | A | A | C |
| TS*5 | A | A | D | A |

*1"EE" is the experiment example.
*2"FSPRz" is the roughness Rz at the first surface portion.
*3"SSPRz" is the roughness Rz at the second surface portion.
*4"VSP" is the vertical stripe phenomenon.
*5"TS" is the toner stagnation.
A: Unrecognizable
B: Very slight
C: Slight
D: Recognizable on normal image
(E: Conspicuous image defect)

As can be understood from the table 2, when the roughness at the second surface portion Z20 on a side downstream of the contact peak pressure portion P1 with respect to the rotational direction Rb of the developing roller is smaller than the roughness at the first surface portion Z10 on a side upstream of the contact peak pressure portion P1 with respect to the rotational direction Rb of the developing roller, a triboelectric charge imparting property lowers, so that the toner stagnation is liable to occur. Incidentally, as can be understood from the experiment example 7, even when the roughness at the downstream-side second surface portion Z20 becomes excessively large, there is a tendency that the vertical stripe phenomenon is liable to occur.

This is because an increase in contact opportunity, i.e., an increase in roughness of the developing blade is effective for imparting the triboelectric charge but it would be considered that there is a possibility of impairment of a flow of the toner after the contact portion CP regulation is made when the roughness becomes excessively large.

It turned out that there is a high possibility that the roughness Rz at the second surface portion Z20 is liable to cause the vertical stripe unless the roughness Rz is at least ½ or less of an average particle size of the toner. In this embodiment, the roughness Rz at the second surface portion Z20 is set so as to be 20% or less of the average particle size of the toner, whereby the occurrence of the vertical stripe is effectively suppressed.

In this embodiment, the average particle size (primary average particle size) of the toner is 8.0 μm or less. Particularly, according to the constitution of this embodiment, when the image is formed with the developer comprising a smaller-particle size toner (for example, 5.0 μm or less in particle size), a further advantageous effect is obtained. That is, even in the case of the small-particle size toner, when the constitution of this embodiment is employed, improvement in uniformity of the amount of the developer (coated layer) on the developing roller is easily realized while effectively suppressing a lowering in charge amount of the developer by the triboelectric charging.

As described above, the roughness is controlled with the contact peak pressure portion P1 in the contact nip N as a boundary, and the roughness in the first region Z1 on a side upstream of the contact peak pressure portion P1 is made smaller than the roughness in the second region Z2 on a side downstream of the contact peak pressure portion P1, so that the occurrence of the vertical stripe and the occurrence of the toner stagnation are easily suppressed compatibly.

Further, a similar evaluation experiment was conducted using toner low in agglomeration degree (i.e., high in flowability) (for example, toner particles sufficiently containing silica as an external additive at surfaces thereof). When the toner low in agglomeration degree is used, of this embodiment, in the experiment examples 2, 3, 4 and 7, it turned out that even when the roughness is roughness at the first surface portion Z10 such that the vertical stripe occurs, a degree of the vertical stripe is suppressed.

This is because as regards the toner low in agglomeration degree, a resistance to the roughness of the developing blade becomes small, and therefore, a difference (non-uniformity) in toner amount with respect to the longitudinal direction, which leads to a generating factor of the vertical stripe hardly generates.

On the other hand, as regards the triboelectric charge impartment to the toner, the triboelectric charge impartation is performed by an increase in contact opportunity through a resistance to the developing blade due to roughness, and therefore, there is a need to increase the roughness in the nip N.

That is, for example, in the toner low in agglomeration degree, although absolute value of the roughness of the first surface portion Z10 and the second surface portion Z20 change, the roughness at the first surface portion Z10 is made smaller than the roughness at the second surface portion Z20, so that both the vertical stripe and the toner stagnation are easily suppressed.

The surface roughness at the first surface portion Z10 and the surface roughness at the second surface portion Z20 are appropriately adjusted in conformity to a physical property of the toner, but by maintaining the relationship as in the present invention, the image defect is easily suppressed. Incidentally, in general, the surface roughness Rz at the first surface portion Z10 can be set in a range of 0.1-1.0 μm, for example. Further, the surface roughness Rz at the second surface portion Z20 can be set in a range of 0.2-2.0 μm, for example.

Thus, the roughness of the developing blade in the contact nip N is controlled on the upstream side and the downstream side with the contact peak pressure portion P1 as the boundary, and the upstream-side roughness is made smaller than the downstream-side roughness, so that the occurrence of the image defect is easily suppressed. Particularly, according to the constitution of the present invention, the vertical stripe generating in the case where the roughness of the developing blade at the contact portion CP is large and the coated layer drop due to the insufficient triboelectric charge occurring in the case where the roughness of the developing blade at the contact portion CP is small are easily suppressed.

The constitution of the present invention can be summarized as follows.

(1) The developing device 2 of the present invention includes the frame 40, the cylindrical developer carrying member rotatably supported by the frame 40 and for carrying the developer T containing the toner particles, and the regulating member 43. The regulating member 43 is fixed to the frame 40 at one end thereof 431 and includes the contact portion CP which contacts the developer carrying member 41 at the other end 432 thereof and which forms the contact nip N between itself and the developer carrying member 41.

When the position O of the contact portion CP where a maximum of a pressure distribution of the contact portion CP to the developer carrying member 41 with respect to the rotational direction Rb of the developer carrying member 41 is the reference position P1, the contact portion includes the first region Z1 positioned upstream of the reference position P1 and the second region Z2 positional downstream of the reference position P1 with respect to the rotational direction Rb, and the contact portion CP has the surface roughness Rz smaller in the first region Z1 than in the second region Z2, the surface roughness Rz in the second region Z2 being 20% or less of an average particle size of the toner particles contained in the developer T.

By this, of the contact nip N, in the first region Z1 on the side upstream of the position (contact peak pressure portion) where the contact peak pressure is set, the surface roughness is relatively small, and the developer easily moves in the axial direction (longitudinal direction) of the developer carrying member. Further, uniformization of the developer coated layer (thickness) with respect to the longitudinal direction is also promoted. At the same time, in the second region Z2 on the side downstream of the position where the contact peak pressure is set, the roughness is relatively large, and the triboelectric charging action on the developer is promoted.

As a result of this, by controlling the surface roughness at the contact portion in the contact nip, uniformity of the developer coating amount in the contact nip is easily enhanced while suppressing a lowering in chargeability.

(2) In the developing device of the present invention, the contact portion CP is capable of including the first surface portion Z10 forming the contact nip N and the second surface portion Z10 positioned downstream of the first surface portion Z10 with respect to the rotational direction and for being connected to the first surface portion Z10 and for forming the contact nip N. The first region Z1 can be formed at the first surface portion Z10, and the second region Z2 can be formed at the second surface portion Z20.

That is, the contact portion CP is capable of being provided with a plurality of the surface portions. Further, with respect to the rotational direction Rb, at the two portions adjacent to the contact peak pressure portion P1, the first region Z1 may also be formed in at least a part of the first surface portion Z10 positioned on the side upstream of the contact peak pressure portion P1, and the second region Z1 may also be formed in at least a part of the second surface portion Z10 positioned downstream of the contact peak pressure portion P1.

(3) In the developing device of the present invention, both the first surface portion Z10 and the second surface portion Z20 may also be constituted by flat surfaces.

incidentally, a portion (corner) connecting the first surface portion Z10 and the second surface portion Z20 which are the flat surfaces can be appropriately subjected to chamfering.

(4) In the developing device of the present invention, the first surface portion Z10 and the second surface portion Z20 may also be constituted by a single curved surface CS with no inflection point.

Incidentally, the curved surface CS may also be formed by connecting a plurality of curved surfaces having different radii of curvature.

(5) In the developing device of the present invention, the surface roughness Rz in the first region Z1 may preferably be 0.21 μm or less.

By this, in the contact nip, movement of the developer in the longitudinal direction becomes easier, so that the uniformity of the coated layer is more promoted.

(6) In the developing device of the present invention, the toner particles may preferably be spherical toner particles of 8.0 μm or less in average particle size.

By this, in the contact nip, the developer can be triboelectric charged more effectively.

(7) In the developing device of the present invention, the other end 432 of the regulating member 43 can be mounted to the frame 40 so as to extend toward the upstream side of the rotational direction Rb of the developer carrying member 41.

In the constitution in which the other end (free end) of the regulating member is mounted so as to extend toward the upstream side, compared with the constitution in which the other end of the regulating member is mounted so as to extend toward the downstream side, the contact pressure is more easily obtained.

(8) In the developing device of the present invention, the regulating member 43 may also be provided with a metal blade 43*a*, and the contact portion CP may also be formed by subjecting an edge portion 43*a*1 of the metal blade 43*a* to polishing.

Incidentally, it is also possible to realize control of the shape and surface roughness of the contact portion CP by a method such as sand blasting or surface etching using an etching agent, as a method other than the method in which the contact portion CP is formed by the polishing.

(9) In the developing device of the present invention, the developing device 2 may also be constituted so as to be mountable in and dismountable from the apparatus main assembly 100*a* of the image forming apparatus 100.

(10) The regulating member 43 of the present invention includes the contact portion CP contacting the rotatable developer carrying member 41 for carrying the developer and capable of forming the contact nip N between itself and the developer carrying member. Further, the contact portion CP includes the first flat surface Z1*p* forming the contact nip N and the second flat surface Z2*p* forming the contact nip N and not only crossing the first flat surface Z1*p* but also being connected to the first flat surface Z1*p*. The first flat surface Z1*p* is positioned upstream of the second flat surface Z2*p* with respect to the rotational direction Rb of the developer carrying member, and the surface roughness Rz in the first flat surface Z1*p* is smaller than the surface roughness Rz in the second flat surface Z2*p*.

(11) The process cartridge 1 of the present invention includes the above-described developing device 2 and the image bearing member 11 for bearing the developer image, and is constituted so as to be mountable in and dismountable from the apparatus main assembly 100*a* of the image forming apparatus 100.

(12) The image forming apparatus 100 of the present invention includes the above-described developing device 2 or the above-described process cartridge 1 and includes the transfer member 51.

According to the present invention, by a simple constitution, the uniformity of the amount of the developer (developer coated layer) with respect to the longitudinal direction can be easily enhanced while suppressing a lowering in chargeability of the developer particles contained in the developer coated layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-173316 filed on Oct. 14, 2020, which is hereby incorporated by reference herein in its entirety.

What is claimed is:

1. A developing device comprising:

a frame;

a cylindrical developer carrying member rotatably supported by said frame and configured to carry a developer containing toner particles; and a regulating member fixed to said frame at one end thereof and including a contact portion which contacts said developer carrying member at the other end of said regulating member and which forms a contact nip between itself and said developer carrying member, wherein when a position of said contact portion where a maximum of a pressure distribution of said contact portion to said developer carrying member with respect to a rotational direction of said developer carrying member is indicated is a reference position, said contact portion includes a first region positioned upstream of the reference position and a second region positioned downstream of the reference position with respect to the rotational direction, wherein a length of said second region is longer than a length of said first region in a position corresponding to said contact nip with respect to a direction from said one end as a fixed end of said regulating member toward said other end as a free end of said regulating member, and wherein said contact portion has a surface roughness smaller in said first region than in said second region, the surface roughness in said second region being 20% or less of an average particle size of said toner particles contained in said developer.

2. A developing device according to claim 1, wherein said contact portion comprises:

a first surface portion for forming the contact nip; and a second surface portion positioned downstream of said first surface portion in the rotational direction and being connected to said first surface portion for forming the contact nip, wherein said first region is formed at said first surface portion, and said second region is formed at said second surface portion.

3. A developing device according to claim 2, wherein said first surface portion and said second surface portion are both constituted by a flat surface.

4. A developing device according to claim 2, wherein said first surface portion and said second surface portion are constituted by a single curved surface having no inflection point.

5. A developing device according to claim 1, wherein the surface roughness in said first region is 0.21 μm or less.

6. A developing device according to claim 1, wherein said toner particles contained in said developer are spherical toner particles having an average particle size of 8.0 μm or less.

7. A developing device according to claim 1, wherein said the other end of said regulating member is mounted to said frame so as to extend toward an upstream side of the rotational direction of said developer carrying member.

8. A developing device according to claim 1, wherein said regulating member includes a metal blade, and wherein said contact portion is formed by subjecting an edge portion of said metal blade to polishing.

9. A developing device according to claim 1, wherein said developing device is mountable in and dismountable from a main assembly of an image forming apparatus.

10. A process cartridge comprising:

a developing device according to claim 1; and an image bearing member configured to bear a developer image, wherein said process cartridge is mountable in and dismountable from a main assembly of an image forming apparatus.

11. An image forming apparatus comprising:

a developing device according to claim 1; and a transfer member, wherein said image forming apparatus forms an image.

12. An image forming apparatus comprising:

a process cartridge according to claim 10; and a transfer member, wherein said image forming apparatus forms an image.

13. A developing device according to claim 1, wherein said regulating member is provided with an endmost surface at an upstream side of said contact portion, said endmost surface being disposed upstream of said second region with respect to the rotational direction.

* * * * *